United States Patent [19]

Collins

[11] Patent Number: 4,819,520

[45] Date of Patent: Apr. 11, 1989

[54] STATIONARY CYLINDER TORQUE WRENCH

[75] Inventor: Bob W. Collins, New Orleans, La.

[73] Assignee: Power Tork Hyraulics, Inc., New Orleans, La.

[21] Appl. No.: 41,682

[22] Filed: Apr. 23, 1987

[51] Int. Cl.[4] ..... B25B 13/46

[52] U.S. Cl. ..... 81/57.39; 81/57.44

[58] Field of Search ..... 81/57.44, 57.4, 57.2, 81/57.39; 92/138, 139; 74/104, 105, 25, 62

[56] References Cited

U.S. PATENT DOCUMENTS 4,607,546 8/1986 Wagner ..... 81/57.39

4,671,142 6/1987 Junkers ..... 81/57.39

*Primary Examiner*—Frederick R. Schmidt

*Assistant Examiner*—Lawrence Cruz

*Attorney, Agent, or Firm*—William D. Kiesel; Robert C. Tucker; Timothy J. Monahan

[57] ABSTRACT

A stationary cylinder hydraulic torque wrench comprising a cylinder fixedly connected to a wrench housing, a track and roller assembly for controlling alignment of a piston rod during a stroke of a piston, and a roller, rotatably connected to the end of the piston rod for transferring power to a lever arm having a convex edge.

12 Claims, 1 Drawing Sheet

STATIONARY CYLINDER TORQUE WRENCH

BACKGROUND OF THE INVENTION

1. Field of the Invention

The present invention relates generally to hydraulic torque wrenches, and more specifically to hydraulic torque wrenches wherein the hydraulic cylinder is stationary with respect to the wrench housing.

2. Description of the Prior Art

Various methods have been used to link the piston rod of a hydraulic cylinder to the lever arm of a torque wrench. One well known method has been to allow the hydraulic cylinder itself to pivot along the arc made by the lever arm. This method requires a larger head to accommodate the hydraulic cylinder as well as the wrench housing. Additionally, there is the hazard and inconvenience of having exposed moving parts.

Another design method is to fixedly attach the hydraulic cylinder to the wrench housing. The piston rod is then linked to the lever arm by a ball joint or by slotted drive plates. Examples of stationary cylinder torque wrenches can be seen in in U.S. Pat. No. 4,201,099, issue date May 6, 1980.

These prior art wrenches, while being more maneuverable are also more prone to wear. A ball and joint linkage allows the piston rod to travel outside the cylinder axis thereby causing side loading of the piston. In the other systems, the piston rod also experiences significant side loads thereby enhancing the possibility of piston and cylinder wall wear and decreasing efficiency.

SUMMARY OF THE INVENTION

Therefore, one object of this invention is to provide a stationary cylinder torque wrench which eliminates side loading of the piston and decreases wear to the piston and cylinder.

Another object of this invention is to provide a stationary cylinder torque wrench which transfers power with greater efficiency.

Still another object of this invention is to provide a stationary cylinder torque wrench which is relatively maintenance free given the lack of moving parts and structural integrity.

Other objects and advantages of this invention shall become apparent from the ensuing description of the invention.

Accordingly, a stationary cylinder torque wrench is provided comprising a wrench housing within which is pivotally connected a lever arm; a cylinder fixedly connected to the wrench housing and a piston which slides within the cylinder; a piston rod connected at one end to the piston and slidably connected to the traveling end of the lever arm at a distal end; a means for keeping the piston rod centered during a stroke of the piston and a means for connecting the lever arm to a workpiece.

PREFERRED EMBODIMENT OF THE INVENTION

Without limiting the scope of this invention, the preferred features of this invention will be described using a particular preferred embodiment of the invention.

Figure 1:
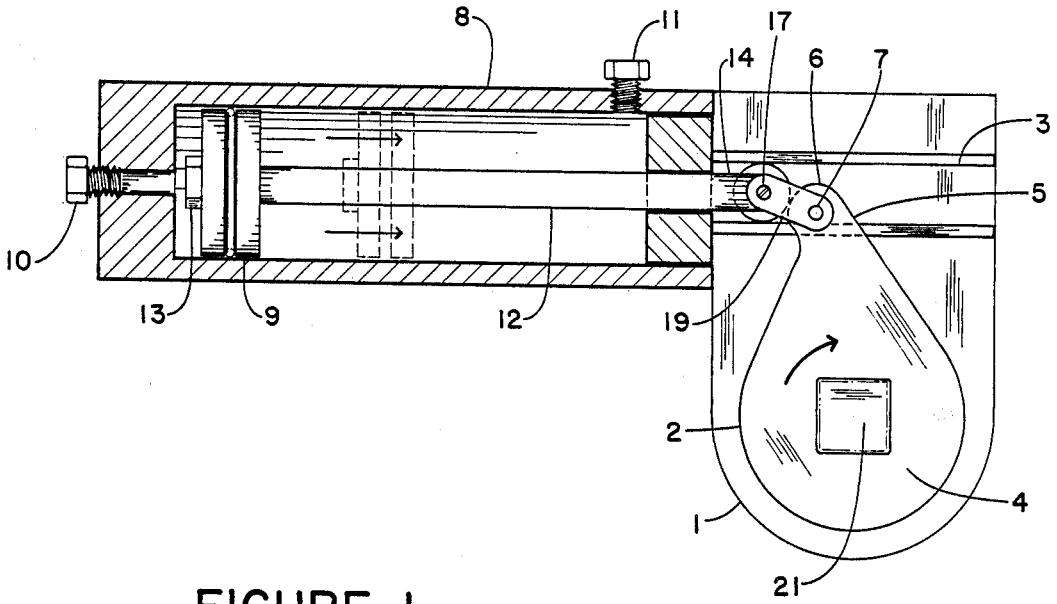
FIG. 1 is a side cutaway view of the preferred embodiment of the stationary cylinder torque wrench.

Referring to FIG. 1, wrench housing 1 contains lever arm 2 and track 3. Lever arm 2 has a pivoting end 4, pivotally connected to wrench housing 1, and a travelling end 5 which can swing freely. Travelling end 5 has convex edge 6 and hole 7 which are positioned to define a sector.

Track 3 is positioned to lie in the same plane as the arc defined by the swing of travelling end 5 of lever arm 2. Track 3 is also positioned to intersect the arc made by travelling end 5.

Cylinder 8 is fixedly connected to wrench housing 1. Cylinder 8 is positioned so that the axis of cylinder 8 is aligned with track 3. Piston 9 slides longitudinally within cylinder 8. Piston 9 is driven by a hydraulic fluid which is alternately received and discharged by cylinder 8 through hydraulic ports 10 and 11.

Piston rod 12 is connected at one end to piston 9 where it is secured by retainer nut 13. Piston rod 12 has distal end 14 which extends into wrench housing 1.

Figure 2:
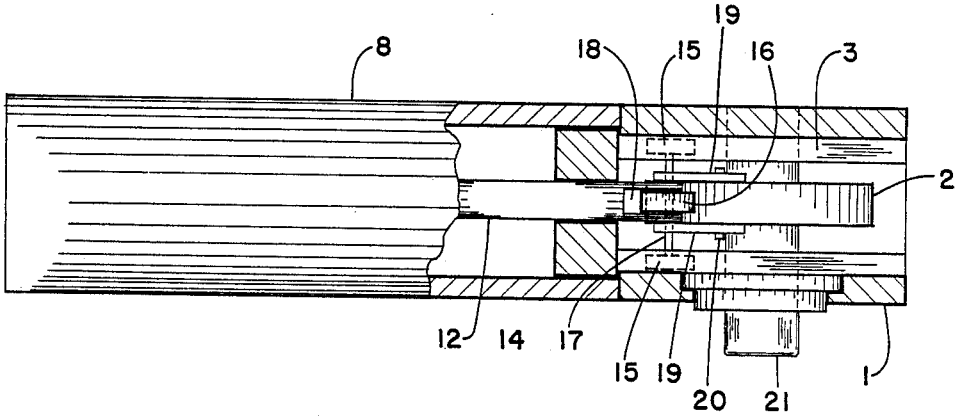
FIG. 2 is an overhead view of a preferred feature of the stationary cylinder torque wrench.

Referring now to FIG. 2, distal end 14 is shown with a guide means for aligning piston rod 12 and a means for slidably connecting distal end 14 and travelling end 5 of lever arm 2. In the preferred embodiment, tracking rollers 15 and power roller 16 are rotatably connected to distal end 14 by pin 17. Distal end 14 has notch 18 to accommodate power roller 16.

Distal end 14 is slidably connected to travelling end 5 of lever arm 2 by rigid retraction bars 19. Retraction bars 19 connect pin 17 and pin 20. Pin 20 is rotatably positioned in hole 7 of travelling end 5. Retraction bars 19 couple distal end 14 and travelling end 5 together while also allowing uninterrupted contact between power roller 16 and convex edge 6 during a stroke of piston 9.

Referring back to FIG. 1, tracking rollers 15 travel longitudinally within track 3 to keep piston rod 12 centered. This prevents side loading of piston 9. Additionally, tracking rollers 15 and track 3 minimizes friction loss in the system.

Square drive 21 is connected to pivoting end 4 of lever arm 2 to allow the wrench to be coupled to a workpiece.

In the preferred embodiment, the angle between piston rod 12 and lever arm 2 is 90° or greater throughout the stroke of piston 9. The aforementioned angle comprises the piston rod, the point of contact between the piston rod and the lever arm and the center of the pivot point of the lever arm. A stroke of piston 9 pivots lever arm 2 through an angle of 15°-30°.

There are, of course, many obvious alternate embodiments and modifications to this invention, such as using pins instead of rollers, which are intended to be included in the scope of this invention as defined by the following claims.

What I claim is:

1. A stationary cylinder, hydraulic wrench for applying torque to a workpiece, comprising:

(a) a wrench housing;

(b) a lever arm within said wrench housing, said lever arm having a pivoting end engaged with said wrench housing, said lever arm further having a traveling end with a convex edge;

(c) a cylinder fixedly connected to said wrench housing, said cylinder positioned so that the axis of said cylinder lies in the same plane as the plane of movement defined by an arc made by said traveling end of said lever arm;

(d) a piston slidable within said cylinder;

(e) a piston rod, having one end connected to said piston and said piston rod further having a distal end extending into said wrench housing said distal end having a convex edge in slidable contact with said convex edge of said traveling end of said lever arm;

(f) a rigid retraction bar pivotally connected at one end to said distal end of said piston rod and pivotally connected at an opposite end to said traveling end of said lever arm;

(g) a track, fixedly connected within said wrench housing and extending longitudinally along the same axis as said cylinder;

(h) a roller, traveling within said track and connected to said distal end of said piston rod; and (i) a means for connecting said pivoting end of said lever arm to a workpiece.

2. A hydraulic wrench according to claim 1, wherein each of said convex edges has a fixed radius.

3. A hydraulic wrench according to claim 1, wherein said track is aligned to intersect said arc made by said traveling end of said lever arm.

4. A hydraulic wrench according to claim 1, wherein at least one of said convex edges is formed by a roller, said roller being aligned to rotate in the same plane as said arc made by said traveling end of said lever arm.

5. A stationary cylinder, hydraulic wrench for applying torque to a workpiece, comprising:

(a) a wrench housing;

(b) a lever arm within said wrench housing, said lever arm having a pivoting end engaged with said wrench housing, said lever arm further having a traveling end with a convex edge;

(c) a cylinder fixedly connected to said wrench housing, said cylinder positioned so that the axis of said cylinder lies in the same plane as the plane of movement defined by an arc made by said traveling end of said lever arm;

(d) a piston slidable within said cylinder;

(e) a piston rod having one end connected to said piston, and a distal end extending into said wrench housing, said distal end having a convex edge in slidable contact with said convex edge of said traveling end of said lever arm;

(f) a connecting means for maintaining contact between said convex edge of said distal end of said piston rod and said convex edge of said traveling end of said lever arm;

(g) a guide means for maintaining alignment of said distal end of said piston rod with the axis of said cylinder during a stroke of said piston; and (h) a means for connecting said pivoting end of said lever arm to a workpiece.

6. A hydraulic wrench according to claim 5 wherein said connecting means comprises a rigid retraction bar having one end pivotally connected to said traveling end of said lever arm and an opposite end pivotally connected to said distal end of said piston rod.

7. A hydraulic wrench according to claim 6 wherein said convex edge of said distal end of said piston is formed by a roller incorporated into said distal end, said roller having an axle pivotally connected to said opposite end of said retraction bar.

8. A hydraulic wrench according to claim 7 wherein said one end of retraction bar is connected to said traveling end at a pivot point, and said pivot point and said convex edge of said traveling end define a sector.

9. A hydraulic wrench according to claim 6 wherein said guide means comprises:

(a) a track fixedly connected within said wrench housing and extending longitudinally along the same axis as said cylinder; and (b) a roller traveling within said track and connected to said distal end of said piston rod.

10. A stationary cylinder, hydraulic wrench for applying torque to a workpiece, comprising:

(a) a wrench housing;

(b) a lever arm within said wrench housing, said lever arm having a pivoting end connected to said wrench housing, said lever arm further having a traveling end with a convex edge;

(c) A cylinder fixedly connected to said wrench housing, said cylinder positioned so that the axis of said cylinder lies in the same plane as the plane of movement defined by an arc made by said traveling end of said lever arm, said cylinder axis further aligned to intersect said arc;

(d) a piston slidably connected within said cylinder;

(e) a piston rod having one end connected to said piston, and a distal end extending into said wrench housing, said distal end further having a power roller rotatably connected thereto with an axle, said axle is aligned perpendicular to said plane of movement of said lever arm;

(f) a guide means for maintaining alignment of said distal end of said piston rod with the axis of said cylinder during a stroke of said piston;

(g) a rigid retraction bar having one end pivotally connected to said roller axle and an opposite end pivotally connected through a hole in said traveling end of said lever arm whereby said hole is positioned in relation to said convex edge of said traveling end to define a sector and to hold said convex edge and said power roller in uninterrupted contact; and (h) a means for connecting said pivoting end of said lever arm to a workpiece.

11. A hydraulic wrench according to claim 10, wherein the guide means further comprises:

(a) a track, fixedly connected within said wrench housing and extending longitudinally on the same axis as said cylinder, said track intersecting said arc made by the movement of said traveling end of said lever arm at least one point; and (b) a tracking roller, rotatably connected to said distal end of said piston rod and positioned within said track so that said tracking roller may only roll longitudinally within said track.

12. A hydraulic wrench according to claim 11, wherein a stroke of said piston pivots said lever arm through an angle of 15°–30°, and wherein an angle between said piston rod and said lever arm is 90° or greater throughout said stroke.

* * * * *